United States Patent [19]

Kawashima et al.

[11] 4,431,945

[45] Feb. 14, 1984

[54] HIGH PRESSURE METAL VAPOR DISCHARGE LAMP

[75] Inventors: Kouzou Kawashima; Akira Ito, both of Yokahama, Japan

[73] Assignee: Tokyo Shibaura Denki Kabushiki Kaisha, Kanagawa, Japan

[21] Appl. No.: 355,190

[22] Filed: Mar. 5, 1982

[30] Foreign Application Priority Data

Mar. 16, 1981 [JP] Japan ..... 56-37724

[51] Int. Cl.[3] ..... H01J 7/44; H01J 17/34; H01J 23/16; H01J 29/96

[52] U.S. Cl. ..... 315/63; 313/619; 313/620; 313/572; 315/47; 315/61; 315/73

[58] Field of Search ..... 313/572, 619, 620, 643; 315/47, 60, 61, 63, 73

[56] References Cited

U.S. PATENT DOCUMENTS

| | | | |
|---|---|---|---|
| 2,784,347 | 3/1957 | Thouret | 315/47 |
| 2,874,324 | 2/1959 | Klepp et al. | 313/572 |
| 3,275,875 | 9/1966 | Wattenbach | 313/620 |
| 3,681,639 | 8/1972 | Kamei et al. | 313/619 |
| 4,064,416 | 12/1977 | Krense et al. | 315/60 |
| 4,253,037 | 2/1981 | Driessen et al. | 313/620 |
| 4,328,445 | 5/1982 | Van Den Plas et al. | 315/47 |
| 4,355,265 | 10/1982 | Cohen et al. | 315/47 |

*Primary Examiner*—Saxfield Chatmon, Jr.
*Attorney, Agent, or Firm*—Schwartz, Jeffery, Schwaab, Mack, Blumenthal & Koch

[57] ABSTRACT

A high pressure metal vapor discharge lamp comprising a discharge tube disposed in an outer jacket; said discharge tube having electrodes and containing a filling comprising a starting rare gas composed primarily of xenon at a pressure from 40 to 200 Torr; means for starting said discharge tube comprising a glow starter comprising a pair of contacts spaced apart not more than 2.5 mm from each other, and containing a gas composed primarily of argon at a pressure of at least 7 Torr; the pressure in said glow starter ($P_g$) being related to the pressure in the discharge tube ($P_i$), according to the expression $$P_g \leqq -\frac{5}{160} P_i + 19.25;$$

and a starting electric conductor adapted to contact the discharge tube on starting thereof and to separate from the discharge tube after starting.

9 Claims, 6 Drawing Figures

HIGH PRESSURE METAL VAPOR DISCHARGE LAMP

BACKGROUND OF THE INVENTION

The present invention relates to a high pressure metal vapor discharge lamp, and more particularly to a high pressure sodium vapor discharge lamp with improved starting characteristics.

High pressure sodium vapor discharge lamps generally have a higher efficiency, i.e., a higher lumen output per watt, than high pressure mercury vapor discharge lamps, metal halide discharge lamps or the like. However, sodium vapor lamps require a specially designed ballast for starting and stable operation because a high starting voltage is needed. The expense of the special ballast hinders general use of high pressure sodium vapor discharge lamps.

A high pressure sodium vapor lamp has been developed which has in its outer jacket a discharge tube and a starting device comprising a heating filament and a thermally responsive switch. Such sodium vapor lamps can be started and stably operated with a ballast for a high pressure mercury vapor discharge lamp. In the starting operation, the thermally responsive switch is operated by the heating filament so that the switching voltage of the thermally responsive switch is converted into high voltage pulses by the induction of the choke coil of the ballast, and the high voltage pulses are impressed upon the electrodes of the discharge tube so that the lamp may be started. Accordingly, such a high pressure sodium vapor discharge lamp does not require any special external high voltage pulse generating device so that it can be used in place of a high pressure mercury vapor discharge lamp in lighting devices equipped with conventional mercury vapor lamp ballast while enjoying the advantage that an intensity of illumination may be attained which is twice as bright as that of a high pressure mercury vapor discharge lamp.

However, a high pressure sodium vapor discharge lamp having such a starting device in its outer jacket generates a pulse voltage as high as 4000 volts in the starting operation due to the action of the thermally responsive switch. When such high voltage pulses are generated, there is a possibility that a dielectric breakdown may occur between the choke coils of the ballast, between the socket and the screw base of the sodium vapor discharge lamp or between other points in the lamp circuit. This possibility is especially high in circuits of mercury vapor lamp lighting devices in which the insulation has deteriorated after years of use.

Particularly in a lamp circuit in which a ballast having a short circuit current of 0.9 to 1.7 amperes, such as a ballast for an 80 watt mercury vapor lamp, is used with 70 to 90 watt sodium vapor lamps, the high pressure sodium vapor discharge lamps have small size bases of the E26 or E27 type so that the possibility of dielectric breakdown occurring at the fitting between the base and the socket during a high voltage starting pulse is quite high. Hence, it is necessary to reduce the pulse voltage at the start. However, if the pulse voltage is reduced, the lamp cannot be started smoothly and the desired lamp operation cannot be attained.

SUMMARY OF THE INVENTION

Accordingly, it is an object of the present invention to provide an improved high pressure metal vapor discharge lamp having a starting device comprising a glow starter.

Another object of the invention is to provide a high pressure metal vapor discharge lamp having improved starting characteristics.

A further object of the invention is to provide a high pressure metal vapor discharge lamp wherein the nature and properties of the filling in the glow starter and the discharge tube are improved.

Still another object of the invention is to provide a high pressure metal vapor discharge lamp which may be started with a low voltage starting pulse.

An additional object of the invention is to provide a high pressure metal vapor discharge lamp which avoids dielectric breakdown.

Yet another object is to provide a high pressure metal vapor discharge lamp which may be smoothly started with an external ballast having short circuit current of 0.9 to 1.7 amperes.

These and other objects are achieved by providing a high pressure metal vapor discharge lamp having an outer jacket with a lamp base at one end thereof, a discharge tube disposed in said outer jacket, said discharge tube being provided with a pair of spaced electrodes and containing a filling comprising a starting rare gas composed primarily of xenon at a pressure from 40 to 200 Torr, means for starting the discharge tube comprising a glow starter disposed in said outer jacket containing a gas composed primarily of argon at a pressure of at least 7 Torr, the pressure in the glow starter ($P_g$) being related to the pressure in the discharge tube ($P_i$) according to the expression $$P_g \leqq -\frac{5}{160} P_i + 19.25,$$

said glow starter being provided with a pair of contacts spaced at most 2.5 mm from each other, and a starting electric conductor connected to one of the electrodes, said starting electric conductor being adapted to contact the discharge tube on starting and to separate from the discharge tube after starting.

BRIEF DESCRIPTION OF THE DRAWINGS

The invention will be explained in further detail with reference to the accompanying drawings wherein like reference numerals denote like parts in the various views.

DETAILED DESCRIPTION OF A PREFERRED EMBODIMENT

Figure 1:
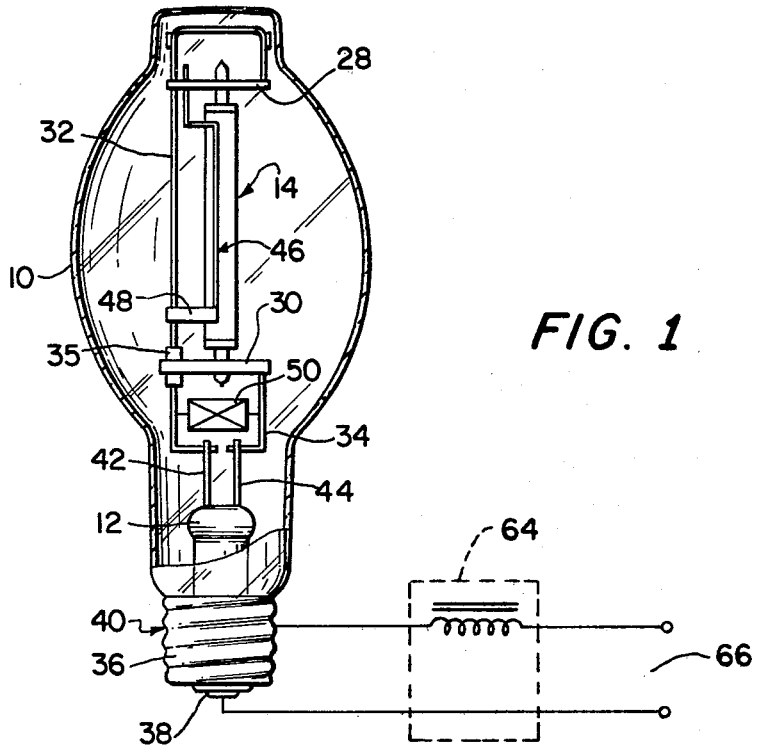
FIG. 1 is an elevational view, partly in cross-section, of a preferred embodiment of the lamp of the invention.

FIG. 1 shows a preferred lamp embodiment comprising a vitreous outer jacket 10 having one end sealed to a stem 12 and a discharge tube 14 disposed in the center of said jacket.

Figure 2:
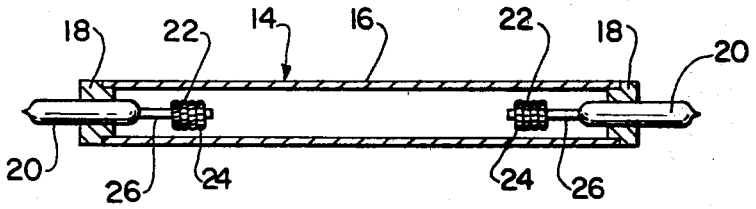
FIG. 2 is an enlarged sectional view of the discharge tube of the lamp of FIG. 1.

As shown in FIG. 2, discharge tube 14 comprises a transparent ceramic tube or bulb 16 having both its ends sealed with caps 18 of, for example, ceramic material. A pair of electrode supporting conductors 20, which act as exhaust tubes, are hermetically extended through caps 18, and a pair of electrodes 22 are connected to the inner ends of electrode supporting conductors 20. Electrodes 22 are prepared by fitting helically coiled tungsten wire electrode portions 24 upon electrode stems 26. Although not shown in the drawing, coiled portions 24 are coated with an electron emitting substance comprising at least one material selected from the group consisting of barium oxide, calcium oxide and yttrium oxide.

Discharge tube 14 contains predetermined quantities of mercury, sodium and xenon which serves as a starting gas. The pressure ($P_i$) of the xenon gas may range from 40 to 200 Torr.

The electrode supporting conductors 20 of discharge tube 14 are supported at their outer end portions by conductive tube holders 28 and 30. Tube holders 28 and 30 are in turn electrically and mechnically connected to and supported by conductive supports 32 and 34. Conductive tube holder 30 is insulated from conductive support 32 by means of a ceramic tube or sleeve 35 through which the conductive support extends. Supports 32 and 34 are connected by lead-in wires 42, and 44, respectively, to the screw base 36 and to the eyelet terminal 38 of an E26 or E27 type base 40 attached to the sealed end of the outer jacket 10. The lead-in wires are sealed in the stem 12. A starting electric conductor 46 made of tungsten or molybdenum is arranged in outer jacket 10 substantially in parallel with the discharge tube 14. One end of starting conductor 46 is supported by a bimetal member 48 fixed on the support 32. The other end of starting conductor 46 is rotatably mounted on holder 28. Starting conductor 46 lies in close contact with the outer surface of discharge tube bulb 16 when the discharge lamp has been off and the lamp is cool, but moves away from discharge tube bulb 16 after the lamp has been turned on because the bimetal member 48 warps, i.e., assumes a curved configuration, as it receives heat from the discharge tube 14.

Figure 3:
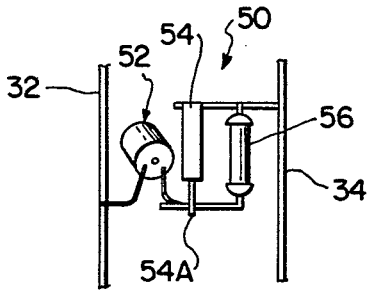
FIG. 3 is an enlarged elevational view of the starting device of the lamp of FIG. 1.

A starting device 50, shown in greater detail in FIG. 3, is connected between the conductive supports 32 and 34 in parallel with the discharge tube 14. A glow lamp starter 52 is connected in series with a normally closed type bimetal switch 54 having a contact 54A. The resulting series circuit is connected between the supports 32 and 34 in parallel with the discharge tube 14. An insulating support 56 is provided for solidly mounting bimetal switch 54 between glow starter 52 and conductive support 34.

Figure 4:
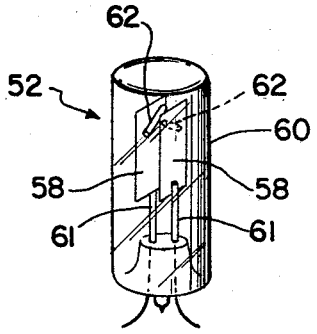
FIG. 4 is an enlarged perspective view of the glow starter from the starting device of FIG. 3.

Glow starter 52 is constructed, as shown in FIG. 4, with a pair of bimetal members 58 held facing each other within an enclosure 60 by conductive holders 61 and with a pair of contacts 62 made of tungsten rods welded to the adjacent faces of bimetal members 58. Conductive holders 61 are connected to conductive support 32 and bimetal switch 54, respectively. The spacing between the contacts 62 in glow starter 52 is 2.5 mm or less.

Argon gas is confined in the glow starter enclosure 60. The pressure of the argon gas ($P_g$) is at least 7 Torr and is related to the pressure of the xenon gas ($P_i$) according to the following expression:

$$P_g \leqq -\frac{5}{160} P_i + 19.25$$

The discharge lamp is connected via a ballast 64 with a power source 66, shown schematically in FIG. 1, by screwing base 40 into an appropriate socket (not shown). Ballast 64 is a single choke type ballast designed for high pressure mercury vapor discharge lamps and has a short circuit current ranging from 0.9 to 1.7 amperes.

The discharge lamp of the invention operates as follows: When the power source 66 is connected, the glow starter 52 is supplied with the secondary no-load voltage of the ballast 64, because the normally closed bimetal switch 54 is closed, so that the glow starter 52 is operated. Starting conductor 46 is initially in contact with the outer surface of discharge tube 14 because bimetal member 48 is in its comparatively straight configuration. In this condition, a pulse voltage is generated by opening of the contacts 62 after the contacts have been closed by glow discharge of glow starter 52. The pulse voltage is superimposed upon the secondary voltage of the ballast 64 and is impressed upon the discharge tube 14. Consequently, when the aforementioned pulse voltage is impressed upon the discharge tube 14, a weak discharge passage is formed within the discharge tube between a portion of the surface of one electrode 22 and the inner surface of the discharge tube 14 adjacent where the tube is contacted by starting conductor 46, and between portions of the surfaces of the two electrodes 22 by the dielectric action of the starting conductor 46. The resulting weak discharge path accelerates electrons and ions so that it is extended into the discharge tube 14 while repeating collisions, ionizations and so on until it induces the arc discharge.

In this way, the discharge tube 14 is started. The temperature of the discharge tube increases as its lighting state becomes more stable. Bimetal member 48 is thus heated by the discharge tube and is warped or caused to assume a curved configuration whereby starting conductor 46 is moved away from discharge tube 14 so that emitted light is not blocked and so that sodium is not lost by absorption into the wall of the discharge tube 14. Normally closed bimetal switch 54 is also heated by the discharge tube 14 so that it is opened to disconnect the power supply circuit from glow starter 52 and maintain the glow starter 52 in an inoperative condition.

The pulse peak value of the glow starter 52 is influenced by the nature and pressure of the gas confined therein and by the size of the spacing between the contacts 62. Since argon is generally used as the confined gas, argon was used in the following experiments. The effects of changes in the argon pressure and changes in the inter-contact spacing on the pulse peak values obtained using a ballast having a short circuit current of 1.3 amperes were determined experimentally and are tabulated in Table 1:

TABLE 1

| Argon Gas | Inter-contact Spacing | | | |
|---|---|---|---|---|
| Pressure ($P_g$) | 0.8 mm | 1.3 mm | 2.5 mm | 3.5 mm |
| 20 Torr | 1000 V | 1200 V | 1300 V | 1400 V |
| 15 Torr | 1200 | 1400 | 1500 | 1700 |
| 10 Torr | 1700 | 1900 | 2000 | 2300 |
| 7 Torr | 2400 | 2500 | 2600 | 3000 |

TABLE 1-continued

| Argon Gas Pressure ($P_g$) | Inter-contact Spacing 0.8 mm | 1.3 mm | 2.5 mm | 3.5 mm |
|---|---|---|---|---|
| 5 Torr | 2600 | 3000 | 3100 | 3300 |

As noted above, it is desired that the pulse voltage be 3,000 volts or less in order to guard against dielectric breakdown. It has been found that there is no likelihood of dielectric breakdown at pulse peak values of 3,000 volts or less even if the discharge tube 14 does not start despite the operation of glow starter 52. In order to maintain the pulse peak value at 3,000 volts or less, it is desirable if the inter-contact spacing is at most 2.5 mm and if the argon gas pressure ($P_g$) is at least 7 Torr.

It should be noted that the pulse peak value can be held to a maximum of 3,000 volts at argon gas pressure as low as 5 Torr if the inter-contact spacing is 0.8 mm, and at inter-contact spacings as large as 3.5 mm if the argon gas pressure ($P_g$) is at least 10 Torr. Such pressures and spacings are considered less desirable because the glow discharge time ($T_G$) from the instant when a voltage is impressed upon the glow starter in order to start the glow discharge between the contacts 62 to the instant when these contacts 62 contact each other increases as the confined gas pressure decreases. Such conditions are also undesirable because the gas deterioration increases as the gas pressure decreases if the glow starter of the lamp is used for a long time.

Experiments conducted with a glow starter identical to that used in the experiments reported in Table 1 have shown that the $T_G$ was initially 1 to 2 seconds but increased to the values tabulated in Table 2 after 6 to 7 hours of continuing operation.

TABLE 2

| Argon Gas Pressure | Inter-contact Spacing 0.8 mm | 1.3 mm | 2.5 mm | 3.5 mm |
|---|---|---|---|---|
| 10 Torr | 3–4 sec. | 3–5 sec. | 5–15 sec. | 10–300 sec. |
| 7 Torr | 3–5 sec. | 5–10 sec. | 6–20 sec. | 20–240 sec. |
| 5 Torr | 30–300 sec. | 40–300 sec. | 50–480 sec. | 20–600 sec. |

It is apparent from Table 2 that glow starters having an argon gas pressure $P_g$ of 5 Torr and an inter-contact spacing of 3.5 mm are not desired because the glow discharge time ($T_G$) increases substantially and becomes highly variable. The $T_G$ after 6 to 7 hours corresponds to the summation of the glow discharge time periods if it is assumed that the glow starter is subjected to the glow discharge for 10 seconds to initially light the discharge lamp, that the initial lighting operation of the discharge lamp is continued for 5 hours and that the life of the discharge lamp is 12,000 hours.

Although Tables 1 and 2 report only results obtained when the short circuit current of the ballast is 1.3 amperes, it has been found that the pulse peak value can be controlled to be 3,000 volts or less when the short circuit current of the ballast is from 0.9 to 1.7 amperes if the inter-contact spacing is at most 2.5 mm and if the argon gas pressure $P_g$ is at least 7 Torr. Results of experiments by which this was determined are tabulated in Table 3:

TABLE 3

| | | Argon Gas Pressure ($P_g$) 5 Torr, Inter-contact Spacing 2.5 mm | 5 Torr, 1.3 mm | 7 Torr, 2.5 mm | 7 Torr, 1.3 mm | 7 Torr, 0.8 mm | 10 Torr, 2.5 mm |
|---|---|---|---|---|---|---|---|
| Short Circuit Current of Ballast | 0.9A | 2700 | 2600 | 2200 | 2100 | 2000 | 1600 |
| | 1.3A | 3100 | 3000 | 2600 | 2500 | 2400 | 2000 |
| | 1.6A | 3300 | 3200 | — | — | — | — |
| | 1.7A | — | — | 2900 | 2800 | 2700 | 2250 |
| | 2.0A | 3600 | 3500 | 3100 | 3000 | 2900 | 2400 |

As can be seen from Table 1, the pulse peak value may vary greatly even though the inter-contact spacing of the glow starter is at most 2.5 mm and the argon gas pressure $P_g$ is at least 7 Torr. It is, therefore, necessary that the glow starter 52 start without fail even with such fluctuations in pulse peak value.

With this in mind, the invention regulates the pressure ($P_i$) of the xenon gas confined in the discharge tube 14. Experiments regarding the difficulty in starting a high pressure sodium vapor discharge lamp using the aforementioned glow starter 52 as the pulse generating starter have shown that when a number of relatively low voltage pulses are generated using the aforementioned glow starter, the starting characteristics of the discharge lamp should be evaluated at two stages. In the first stage, weak discharge paths are discontinuously formed within the discharge tube 14 between one electrode 22 and the inner surface of the wall of the discharge tube 14 in the vicinity of the starting conductor 46 and between the two electrodes 22 by the impression of the pulse voltage. In the second stage, the weak discharge accelerates the charged particles, i.e., electrons or ions, to enlarge the discharge path as a result of collisions, ionizations, etc., until the discharge path shifts to arc discharge between the electrodes 22.

Initially, it is necessary that the weak discharge path be formed and maintained without fail as a result of the action of starting conductor 46. The results of experiments to determine the probability that the weak discharge path of the first stage will be formed within 10 seconds using the glow starter used in the experiments reported in Table 1 are tabulated in Table 4:

TABLE 4

| Kind of Glow Starter | Xe Gas Pressure in Discharge Tube 40 Torr | 100 Torr | 200 Torr | 250 Torr | 300 Torr |
|---|---|---|---|---|---|
| Pulse Peak Value: 1,000 volts Inter-contact Spacing: 0.8 mm Ar Gas Pressure: 20 Torr | 100% | 100% | 100% | 60% | 20% |
| Pulse Peak Value: 1,900 volts Inter-contact Spacing: 1.3 mm Ar Gas Pressure: 10 Torr | 100 | 100 | 100 | 70 | 30 |
| Pulse Peak Value: 2,600 volts Inter-contact Spacing: 2.5 mm Ar Gas Pressure: 7 Torr | 100 | 100 | 100 | 70 | 40 |

It can be seen from Table 4 that the probability of formation of the weak discharge path decreases, when the zenon gas pressure in the discharge tube exceeds 200 Torr, so that starting within 10 seconds is not assured.

Since a high xenon gas pressure in the discharge tube generally lowers the restriking voltage thereby lowering the extinguishing voltage, the time period to the instant when the lamp is extinguished after it has been lit for a long time is increased so that the life of the discharge lamp is extended and so that the luminous efficiency is improved. However, the starting characteristics deteriorate if the pressure of the xenon gas is raised. Table 4 verifies that the starting characteristics of the combination with the glow starter deteriorate. The discharge tube used in the experiments reported in Table 4 was an alumina tube having an internal diameter of 4.0 mm and an inter-electrode spacing of 29 mm. The ballast used in these experiments had a short circuit current of 1.3 amperes and a secondary no-load voltage of 220 volts.

Next, the shift to reliable arc discharge may not be effected in the second stage even when the weak discharge path is formed without fail at the indicated gas pressure. When the weak discharge path is formed, glow discharge also occurs between the contacts of the glow starter, and the so-called secondary voltage of the ballast is shunted between the weak discharge path and the glow discharge path of the glow starter. As the current flowing through the glow tube increases, the number of charged particles in the discharge tube is reduced so that the weak discharge path cannot be sufficiently widened. Instead, when the pressure of the xenon gas in the discharge tube is high, the charged particles cannot attain sufficient energy to cause the needed collisions, ionizations and so on, so that the discharge is interrupted.

Figure 5:
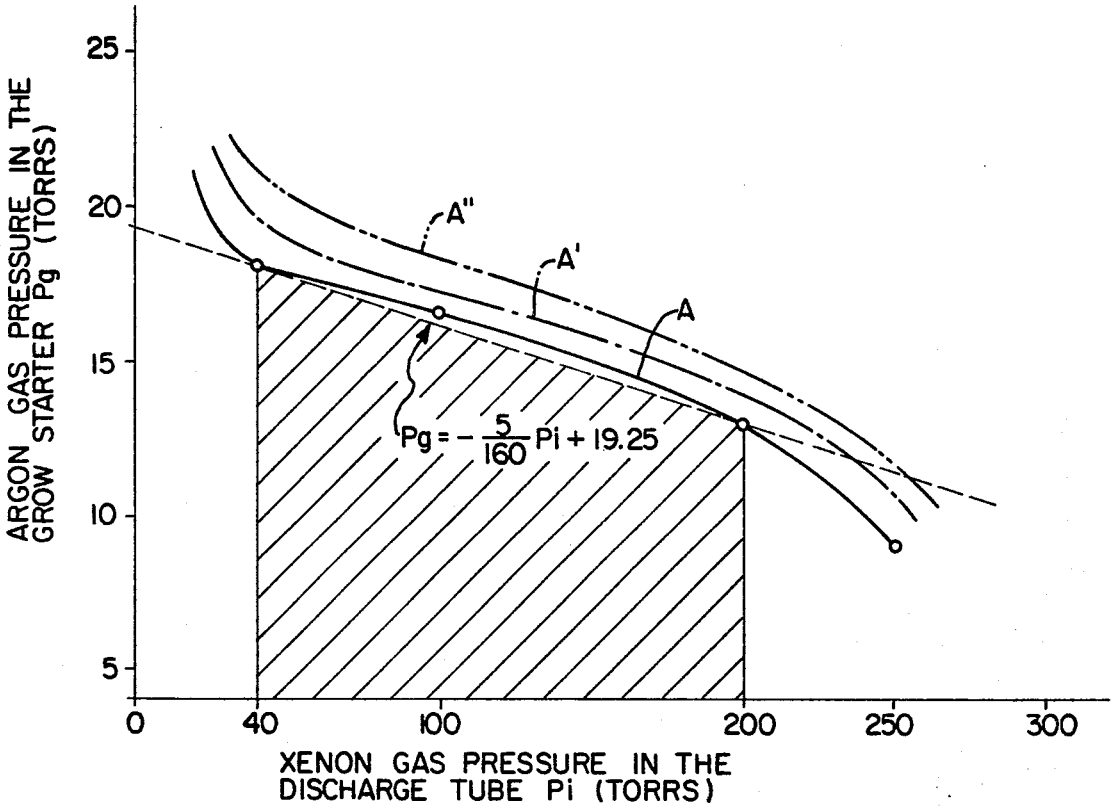
FIG. 5 is a graph depicting the starting characteristics of the lamp with respect to the relationship between the gas pressure in the glow starter and the gas pressure in the discharge tube.

FIG. 5 is a graph of the results of experiments to determine whether or not the arc discharge occurred in the discharge lamp within 10 seconds from starting of discharge depending on changes in the argon gas pressure in the glow starter and on changes in the xenon gas pressure in the discharge tube. A glow starter as used in the experiments reported in Table 1 having an inter-contact spacing of 0.8 mm was used in the experiments. In FIG. 5, the portion appearing to the left of and below curve A corresponds to the range within which the discharge is ensured and which is approximately defined by the expression:

$$P_g \leqq -\frac{5}{160} P_i + 19.25$$

Similar experiments conducted using glow starters having inter-contact spacings of 1.3 mm and 2.5 mm have shown that the curve A has a tendency to be shifted similarly to curves A' and A", but that the start is ensured if the determining point at least falls in the range below the curve A.

The gas pressure $P_i$ of the xenon in the discharge lamp should be at least 40 Torr. When a glow starter is used as the starter, a number of pulses are applied to the discharge tube at each start. This invites the possibility that the end portions of the discharge tube will be blackened as a result of splashing of the substance from which the electrodes are made. The possibility of blackening is greater at lower xenon gas pressures. The blackening of the end portions invites reduction in the flux of light maintaining percentage.

Figure 6:
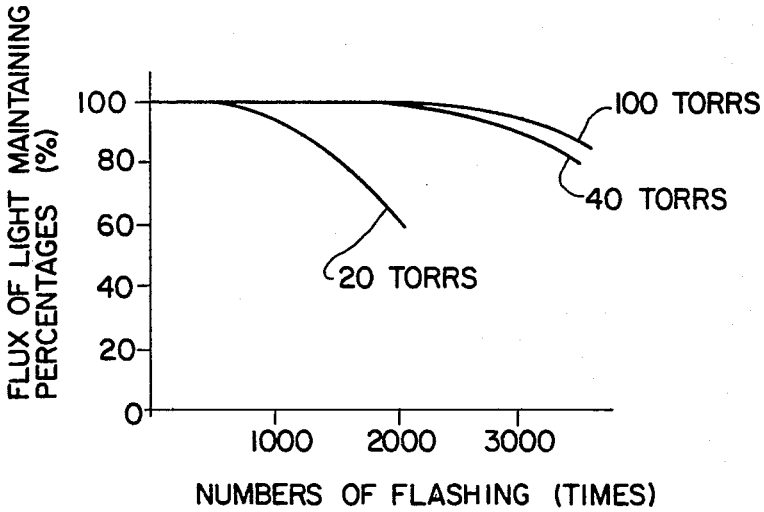
FIG. 6 is a graph showing the influence of the gas pressure in the discharge tube upon the light flux maintaining percentage of the lamp.

Experiments have been conducted using a ballast having a short circuit current of 1.3 amperes, a glow starter having an inter-contact spacing of 1.3 mm and containing argon at a pressure of 10 Torr, and a discharge tube having an internal diameter of 4.0 mm and an inter-electrode spacing of 29 mm. FIG. 6 is a graph of the results of flashing tests of lighting the discharge lamp for 15 minutes and extinguishing the same for 20 minutes conducted to attain such flux of light maintaining percentages for different xenon pressures in the discharge tube. As can be seen from FIG. 6, when the xenon gas pressure is lower than 40 Torr, the flux of light maintaining percentages is reduced undesirably.

In accordance with the hatched range shown in FIG. 5, therefore, the xenon gas pressure ($P_i$) in the discharge tube should lie within the range defined by the expression: $40 \leqq P_i \leqq 200$ (Torr); the argon gas pressure ($P_g$) in the glow starter should lie within the range defined by the expression:

$$7 \leqq P_g \leqq -\frac{5}{160} P_i + 19.25 \text{ (Torr)};$$

and the inter-contact spacing of the glow starter should be at most 2.5 mm.

Desirably, the inter-contact spacing of the glow starter will be at least 0.8 mm to minimize possible trouble with the brazed contacts while taking into account production tolerances.

The argon gas in the glow starter need not be limited to pure argon. The invention includes the use of mixtures of argon with, for example, up to about 30 mole percent neon and/or helium. Since neon or helium has a lighter mass than argon, the thermal conduction loss due to diffusion is increased to raise the pulse peak value. For example, the pulse peak voltage for a mixture containing up to about 30 mole percent neon or helium diluent rises about 10% higher than that for pure argon. Nevertheless, the invention can be practiced because the pulse peak voltage does not exceed 3,000 volts if the inter-contact spacing is at most 2.5 mm and if the argon gas pressure is at least 7 Torr.

Similarly, the starting rare gas in the discharge lamp need not be limited to pure xenon. However, the starting gas should be composed primarily of xenon. No difficulties arise if up to about 30 mole percent of the xenon is replaced with krypton and/or argon.

A preferred high pressure sodium vapor lamp according to the invention may be constructed as follows. A transparent alumina tube having an internal diameter of 4.0 mm was used as the discharge tube, and coil electrodes were arranged therein facing each other at a spacing of 29 mm. A barium, calcium or yytrium emitter was applied to the electrodes. In the discharge tube were confined 3 mg sodium, 17 mg mercury, and xenon gas at a pressure of 70 Torr. A molybdenum wire having a diameter of 0.3 mm was arranged, as shown in FIG. 1, as the starting conductor along the outer surface of the discharge tube. The glow starter had an inter-contact spacing of 1.3 mm and contained argon at a pressure of 12 Torr. The glow starter contacts were prepared from pieces of 1.0 mm diameter tungsten rod and welded to bimetal members having a length of 10 mm, a width of 2 mm, a thickness of 0.15 mm, a warping modulus of $12 \times 16^{-6}/°$ C. and an elastic modulus of 175,000 kg/mm$^2$. The resulting glow starter was connected in series with a normally closed type bimetal switch and was assembled into the lamp as shown in FIG. 1. The outer jacket of the lamp was attached to an E26 type screw base, which was then fitted in a socket. The discharge lamp was used in combination with a ballast having a short circuit current of 1.3 amperes.

The discharge lamp achieved stable lighting operation at a lamp voltage of 100 to 120 volts and a lamp current of 0.75 to 0.95 amperes. A pulse peak voltage of 1,700 volts was attained when the glow starter was operated. As a result, the discharge lamp started without fail within 5 seconds.

The foregoing description has been set forth merely to illustrate the invention and is not intended to be limiting. Since modifications of the disclosed embodiments incorporating the spirit and substance of the invention may occur to persons skilled in the art, the scope of the invention is to be limited solely with respect to the appended claims and equivalents.

We claim:

1. A high pressure metal vapor discharge lamp comprising:

an outer jacket having a lamp base at one end;

a discharge tube disposed in said outer jacket, said discharge tube being provided with a pair of spaced electrodes and containing a filling comprising a starting rare gas at a pressure from 40 to 200 Torr, said rare gas being composed primarily of xenon;

means for starting said discharge tube comprising a glow starter having a pair of contacts spaced at most 2.5 mm from each other and containing a glow starter gas composed primarily of argon at a pressure satisfying the expression $$7 \leqq P_g \leqq -\frac{5}{160} P_i + 19.25 \text{ (Torr)}$$

where $P_g$ represents the gas pressure in the glow starter and $P_i$ represents the rare gas pressure in the discharge tube; and a starting electric conductor connected to one of said discharge tube electrodes, said starting conductor contacting said discharge tube on starting of the discharge tube and separating from the discharge tube after starting.

2. A high pressure metal vapor discharge lamp according to claim 1, wherein said means for starting said discharge tube is connected in parallel with said discharge tube.

3. A high pressure metal vapor discharge lamp according to claim 1, wherein said filling further comprises predetermined amounts of mercury and sodium.

4. A high pressure metal vapor discharge lamp according to claim 1, wherein said starting rare gas comprises up to about 30 mole percent of a gas selected from the group consisting of krypton, argon, and mixtures thereof.

5. A high pressure metal vapor discharge lamp according to claim 1, wherein said discharge tube is supported by conductive supports connected to said base by electrode supporting conductors.

6. A high pressure metal vapor discharge lamp according to claim 5, wherein said means for starting said discharge tube is connected and supported between said conductive supports.

7. A high pressure metal vapor discharge lamp according to claim 1, wherein said means for starting said discharge tube further comprises a normally closed bimetal switch connected in series with said glow starter.

8. A high pressure metal vapor discharge lamp according to claim 1, wherein said glow starter gas comprises up to about 30 mole percent of a gas selected from the group consisting of neon, helium and mixtures thereof.

9. A high pressure metal vapor discharge lamp according to claim 1, wherein said pair of contacts of said glow starter are spaced apart at least 0.8 mm.

* * * * *